US012139825B2

(12) United States Patent
Rosberg

(10) Patent No.: US 12,139,825 B2
(45) Date of Patent: Nov. 12, 2024

(54) COMPOSITE YARN SPUN OF SEPARATE FIBERS AND A FABRIC KNITTED BY SUCH A YARN

(71) Applicant: Transforming Textiles AB, Tyringe (SE)

(72) Inventor: Sara Rosberg, Tyringe (SE)

(73) Assignee: Transforming Textiles AB, Tyringe (SE)

( * ) Notice: Subject to any disclaimer, the term of this patent is extended or adjusted under 35 U.S.C. 154(b) by 0 days.

(21) Appl. No.: 18/184,926

(22) Filed: Mar. 16, 2023

(65) Prior Publication Data

US 2024/0247414 A1 Jul. 25, 2024

(30) Foreign Application Priority Data

Jan. 20, 2023 (EP) ..... 23152596

(51) Int. Cl.

| | |
|---|---|
| ***D02G 3/04*** | (2006.01) |
| ***D02G 3/36*** | (2006.01) |
| ***D02G 3/38*** | (2006.01) |

(52) U.S. Cl.

CPC ..... *D02G 3/042* (2013.01); *D02G 3/36* (2013.01); *D02G 3/38* (2013.01); *D10B 2201/08* (2013.01)

(58) Field of Classification Search

CPC . D02G 3/04; D02G 3/042; D02G 3/36; D10B 2201/08

See application file for complete search history.

(56) References Cited

FOREIGN PATENT DOCUMENTS

| | | | | | |
|---|---|---|---|---|---|
| CN | 104783334 | A | | 7/2015 | |
| CN | 108642656 | A | | 10/2018 | |
| CN | 109680375 | A | | 4/2019 | |
| CN | 114258273 | A | * | 3/2022 | ..... A41D 13/0015 |
| KR | 102224360 | B1 | * | 3/2021 | |
| RO | 133514 | B1 | * | 4/2021 | |
| TW | 201207002 | A | | 2/2012 | |
| WO | WO-2008089224 | A1 | * | 7/2008 | ..... D01F 6/30 |
| WO | WO-2022018138 | A1 | * | 1/2022 | ..... A41D 13/0015 |

* cited by examiner

*Primary Examiner* — Shaun R Hurley

(74) *Attorney, Agent, or Firm* — Capitol City TechLaw

(57) ABSTRACT

A composite yarn spun of separate fibers may include a soybean fiber; a cellulose fiber with incorporated organic seaweed; and a Ramie fiber. A knitted fabric composition may include yarns as defined above.

3 Claims, 1 Drawing Sheet

COMPOSITE YARN SPUN OF SEPARATE FIBERS AND A FABRIC KNITTED BY SUCH A YARN

This application claims priority under 35 USC 119(a)-(d) from EP 23152596.5 filed on Jan. 20, 2023, the entire contents of which are incorporated herein by reference.

BACKGROUND

1. Technical Field

The present invention relates to a composite yarn spun of separate fibers.

2. Discussion of Related Art

Fabrics made of different fibers are used for many types of garments. By using different fibers, it is possible to obtain properties that normally cannot be obtained with a single type of fiber. Composite yarns are employed in the manufacture of knitted garments, shirts, jeans, and other textile products.

From the above it is understood that there is room for improvements and the invention aims to solve or at least mitigate the above and other problems. The present invention provides a high-performance yarn with adaptable surface optic and/or haptic aspects.

SUMMARY

The invention is defined by the appended independent claims. Additional features and advantages of the concepts disclosed herein are set forth in the description which follows, and in part will be obvious from the description, or may be learned by practice of the described technologies. The features and advantages of the concepts may be realized and obtained by means of the instruments and combinations particularly pointed out in the appended claims. These and other features of the described technologies will become more fully apparent from the following description and appended claims, or may be learned by the practice of the disclosed concepts as set forth herein.

The disclosed composition product is spun in a mechanical process like a yarn with properties more like a thread. Unlike a normal yarn with comparatively high breakage and fragileness, the composition product comprises at least three different fibers making it substantially more stable than ordinary yarn. The disclosed composition product can be referred to as a yarn-thread due to its combined properties.

A knitted fabric produced by the disclosed composition product will have a smooth silky feel and be easier to recycle by reversing the mechanical process used for the spinning. In various embodiments, such a fabric will be more readily recycled and the different fibers can be recovered.

BRIEF DESCRIPTION OF THE DRAWINGS

In order to best describe the manner in which the above-described embodiments are implemented, as well as define other advantages and features of the disclosure, a more particular description is provided below and is illustrated in the appended drawings. Understanding that these drawings depict only exemplary embodiments of the invention and are not therefore to be considered to be limiting in scope, the examples will be described and explained with additional specificity and detail through the use of the accompanying drawings in which.

DEFINITIONS

Figure 1:
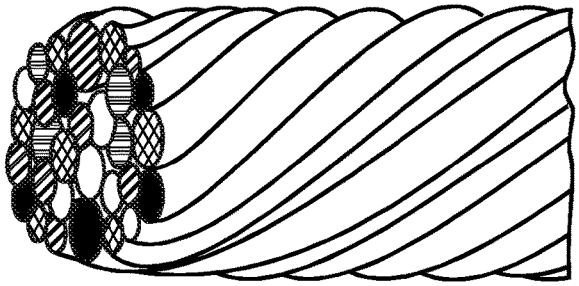
FIG. 1 is a schematic perspective view of a disclosed composite yarn.

A cellulose fiber with incorporated organic seaweed comprises a raw plant material that contains polymer-bound uronic acids. The term "raw plant material" can include all naturally occurring plants and plant parts of terrestrial or marine origin, which contain polymer-bound uronic acids. Preferably, the raw plant material is selected from the group consisting or formed of fruits, seeds, leaves, roots, stems, and/or stalks, and comprises particularly preferably pectin-containing plant parts and/or uronic acid-containing marine plants. Examples of pectin-containing plant parts include citrus fruits as well as the infructescence of sunflowers, pears, apples, guavas, quinces, plums, and/or gooseberries. Also, residue resulting from juice production (pomace) is suitable. Examples of uronic acid-containing marine plants include in particular marine plants which are composed of polysaccharides containing uronic acid, such as algae, kelp, and seaweed. The algae may be brown algae, and in particular brown algae of the genera Ascophyllum, Durvillea, Eclonia, Fucus, Laminaria, Lessonia and Macrocystis, are considered to be especially preferred.

An example of a cellulose fiber with incorporated organic seaweed is available under the trademark SEACELL™ from smartfiber AG, Rudolstadt, Germany.

DETAILED DESCRIPTION

Various embodiments of the disclosed methods and arrangements are discussed in detail below. While specific implementations are discussed, it should be understood that this is done for illustration purposes only. A person skilled in the relevant art will recognize that other components, configurations, and steps may be used without parting from the spirit and scope of the disclosure.

In the description and claims the word "comprise" and variations of the word, such as "comprising" and "comprises", does not exclude other elements or steps.

Hereinafter, certain embodiments will be described more fully with reference to the accompanying drawings. It will be apparent to those skilled in the art that various modifications and variations can be made without departing from the inventive concept. Other embodiments will be apparent to those skilled in the art from consideration of the specification and practice disclosed herein. The embodiments herein are provided by way of example so that this disclosure will be thorough and complete, and will fully convey the scope of the inventive concept, and that the claims be construed as encompassing all equivalents of the present inventive concept which are apparent to those skilled in the art to which the inventive concept pertains. If nothing else is stated, different embodiments may be combined with each other.

The disclosed yarn, or yarn-thread, is composed of at least three different fibers with somewhat different properties. The basic yarn composition comprises three basic fibers, soybean fiber (45%-55%), cellulose fiber with incorporated organic seaweed (25%-35%), and Ramie fiber (17%-22%), where %-age is by weight.

In the soybean protein fiber there are many substances that could control kinds of germina like *Staphylococcus Aureus*, Bacilluscoli, and *Candida Albicans* etc. As in the soybean protein, has its elements such as soybean isoflavones, soybean saponin, and oligosaccharide etc. The far-infrared and negative oxyanion in soybean fiber also has the function of antibacterial.

Furthermore, soybean protein (Albumin) fiber can produce the negative oxygen ion (Oxyanion). When wearing the clothing with good negative oxygen ion, can improve the microclimate, and microenvironment at anytime and anywhere, which is advantage to health but also guarantees fresh air and improves the air quality around the wearer. Tests show that the negative oxyanion, in pure soybean protein fabrics, reach up to 5000 pieces per $cm^3$, which is like those in the field and suburbs.

The soybean fiber also has very good far infrared properties. The good thermal reaction, to cause a series of physiological effects, such as improving human micro cycles, enhancing the swallowing of phagocyte in the organism blood, thus the products can improve human's immunity and decease-resistant ability, which has the function of sterilization, swollen lessing, blood invigorating and pain easing, and activate active organization cell of biology macro molecules. Furthermore, soybean protein fiber has gained ultraviolet radiation reflection function by adding some catalyses to the soybean protein by biotechnology methods. It has been shown that soybean has a strong function to reflect the ultraviolet radiation.

Soybean fiber, sometimes referred to as soysilk, has a touch comfortable function, soft smooth excellent appearance on the skin. Soysilk fiber is soft like silk yet warm, like cashmere. It wicks away moisture and has a soft, gentle drape. Technical details of an appropriate soybean fiber are: Braking tenancy 2.6 CN/dtex; Elongation at break rate: 20%; Crimp rate 6.94%; and content of oil: 0.68%. In various embodiments, the soybean fiber has vinylon carrier with around 77% vinylon carrier and around 23% soybean protein.

The cellulose fiber with incorporated organic seaweed can have the properties 1.7 dtex/38 mm and be provided as a staple fiber. Generally, seaweed is a renewable, cellulosic fiber that has its origins in ocean waters. It is normally blended with other cellulosic fibers to manufacture woven and knitted fabrics. The cellulose in the fiber is wood pulp and can be made out of *eucalyptus, eucalyptus* hybrids, acacia and spruce.

Ramie is a linen-like fiber which is classified as a cellulose fiber and is made from the stalks of the Chinese nettle plant. Ramie is an eco-friendly fabric and the highly sustainable fiber is an alternative to synthetic fabrics. It is naturally resistant to mold, mildew and bacteria, as well as light damage and rot and insect attacks.

The individual Ramie fiber cells normally are quite long, averaging 13 to 15 cm (5 to 6 inches) in length. Ramie fiber is pure white in colour, lustrous, moisture-absorbent, and readily dyed. The fiber is stronger than flax, cotton, or wool. Fabric made from ramie fiber is easily laundered, increasing in strength when wet, and does not shrink or lose its shape. It dries quickly and becomes smoother and more lustrous with repeated washings. Ramie is resistant to mildew and other types of microorganism attack and does not change colour with prolonged exposure to sunlight.

In various embodiments, the disclosed yarn comprises a silver coated fiber. The silver coated fiber can be a polyamide/nylon fiber plated with pure silver. Other properties of the silver coated fiber are: titer raw material 1.5 dtex; titer silverized 1.7 dtex; twist Z 60; make up cut in approximately 40-60 mm and electric resistivity ≤600 Ω/m. The silver content will provide antiseptic and antibacterial properties to the yarn and to any fabric made by the disclosed yarn. The conductive properties provided by the silver coated fiber can also be used to transfer electric signals and for connecting sensors and other electronic components.

In various embodiments, a cellulose fiber enriched with incorporated pharmaceutically pure zinc oxide is used in the production of the disclosed yarn. These fibers are based on a modified Lyocell process, an environmentally friendly manufacturing method using wood pulp as raw material. Zinc oxide is embedded permanently into the fiber. The zinc oxide added will prevent the formation of bacteria and virus from the body of a person wearing textiles and fabrics made by the disclosed yarn. It will also restrain the odor. The addition of an essential trace element zinc will enable regenerative skin care and hygiene in textiles produces by the disclosed yarn. The fiber composition in conditioned state (% by weight) is: cellulose ≥73%; zinc oxide 16%; fiber finish 0.32%; and moisture content ≤12%. The average physical fiber has a cut length of 38 mm and a titer of 2.5 dtex. The cellulose is wood pulp and can be made out of eucalyptus, eucalyptus hybrids, acacia, acer, birch and poplar/aspen.

An example of a cellulose fiber with embedded zinc oxide is available under the trademark SMARTCEL from smartfiber AG, Rudolstadt, Germany.

When the yarn is produced by combining the fibers, a ring spinning process where at least three fibers spun together in the basic yarn composition. The same process can be used when the three basic fibers are combined with a silver coated fiber and a cellulose fiber enriched with zinc oxide. When all five fibers are combined into the yarn composition, the content of each fiber type should be: 30% to 40% soybean fiber, 15% to 25% cellulose fiber enriched with zinc oxide, 15% to 25% cellulose fiber with incorporated organic seaweed, 12% to 18% Ramie fiber, and 8% to 12% silver coated fiber, where % is by weight.

In implementations of the yarn, it has been shown that very good properties exist in a composition with five fibers in a blend of 35% soybean fiber, 20% cellulose fiber enriched with zinc oxide, 20% cellulose fiber with incorporated organic seaweed, 15% Ramie fiber, and 10% silver coated fiber, where % is by weight. The five different fibers are used to produce a ring spun yarn with the blend stated above and with the property 30/1 Ne. This will result in a smooth yarn even though plant-based fibers are rigid. Also, the amount of breaks in the yarn composition will be lower. Preferably, the yarn is elastane-free.

Figure 2:
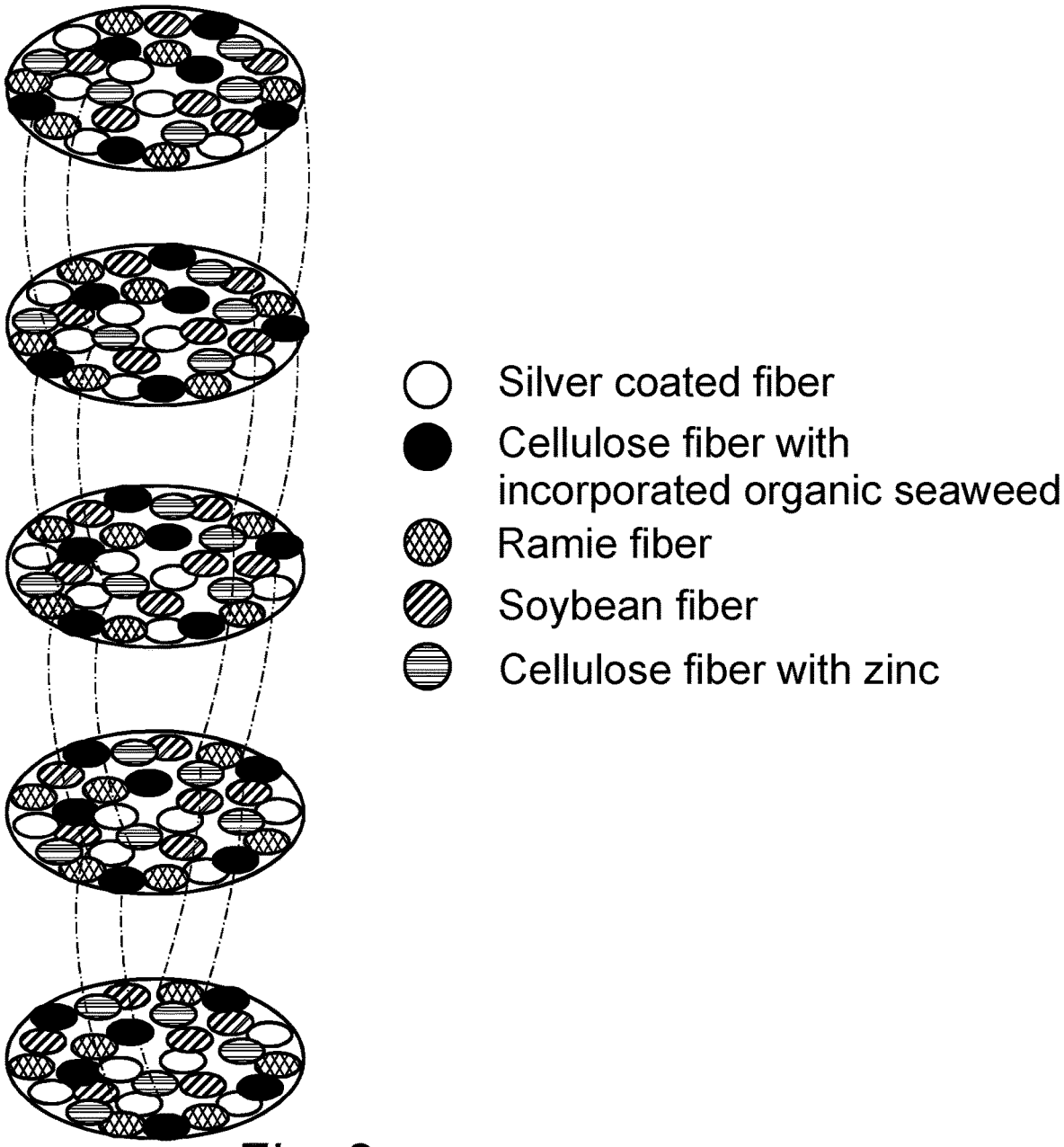
FIG. 2 is a schematic perspective view showing five axially separated sections of an example of the disclosed yarn.

An example of a configuration of the yarn is shown in FIG. 1 and FIG. 2 and comprises the five fibers mentioned above. The five fibers are distributed in the yarn. In various embodiments, the yarns are evenly distributed. In the figures, the different yarns are as shown in the table included in FIG. 2.

○ Silver coated fiber
● Cellulose fiber with incorporated organic seaweed
◍ Ramie fiber -continued

| | |
|---|---|
| | Soybean fiber |
| | Cellulose fiber with zinc |

In various embodiments, the cellulose fiber enriched with zinc oxide and the silver coated fiber are provided centrally in the yarn. In such embodiments, the cellulose fiber with incorporated organic seaweed, the Ramie fiber and the soybean fiber are provided peripherally in a ring shape around the centrally arranged fibers. In this way, the fibers with metallic content are enclosed by the other fibers and will not come into direct contact with the skin of a user wearing a garment made by a fabric containing the yarn.

When a fabric is produced from the disclosed yarn in a knitting process any desired elastane can be used.

The various embodiments described above are provided by way of illustration only and should not be construed to limit the invention. Those skilled in the art will readily recognize various modifications and changes that may be made to the present invention without following the example embodiments and applications illustrated and described herein, and without departing from the scope of the present disclosure.

The invention claimed is:

1. A composite yarn spun of separate fibers, comprising:
a soybean fiber;
a cellulose fiber enriched with zinc oxide;
a cellulose fiber with incorporated organic seaweed:
a Ramie fiber; and
a silver coated fiber;
wherein the content of each fiber is:
35% soybean fiber;
20% cellulose fiber enriched with zinc oxide;
20% cellulose fiber with incorporated organic seaweed;
15% Ramie fiber; and
10% silver coated fiber;
wherein % is by weight.

2. A knitted fabric composition comprising yarns as defined in claim 1.

3. A composite yarn as claimed in claim 1, wherein all fibers are ring spun together.

* * * * *